United States Patent [19]

Roye

[11] 4,072,351

[45] Feb. 7, 1978

[54] RADIAL MINING METHOD

[76] Inventor: Henry L. Roye, 801 NW. Third, Stigler, Okla. 74462

[21] Appl. No.: 761,797

[22] Filed: Jan. 24, 1977

[51] Int. Cl.[2] ..... E21C 41/00

[52] U.S. Cl. ..... 299/11; 98/50; 299/12; 299/18; 299/19

[58] Field of Search ..... 299/11, 12, 18, 19

[56] References Cited

U.S. PATENT DOCUMENTS

| | | | |
|---|---|---|---|
| 3,582,138 | 6/1971 | Loofbourow et al. | 299/18 X |
| 3,975,053 | 8/1976 | Kochanowsky | 299/19 X |
| 4,007,966 | 2/1977 | Wenneborg | 299/12 X |

*Primary Examiner*—Ernest R. Purser
*Attorney, Agent, or Firm*—Head, Johnson & Chafin

[57] ABSTRACT

A method of mining a large underground seam of mineral such as coal is described in which a first cylindrical shaft is drilled from the surface of the earth down to the mineral seam. A portion is enlarged at the base of the first shaft as a work room. A first radial shaft out to a selected radius R is drilled by conventional methods with the roofs supported by means such as hydraulic chocks which can be extended and moved selectively as the line of drilling progresses. When the first shaft is drilled a continuous miner working on a short face method of mining is directed radially from the work room and is advanced outwardly until the width of the first radial shaft is such that the original wall of the first shaft has been cut away. The direction of the miner is then turned to be parallel to the first horizontal shaft and a short wall cutting advance is made to cut away the first wall of the first shaft and in effect drill a second shaft having a first wall spaced by the width of the cutter. A continuous flexible curtain is provided between the floor and roof on the back side of the chocks so that fresh air can be brought down through the vertical shaft and radially outward toward the working face and back on the outside of the flexible curtain toward the working room and up to the surface in a second vertical slope shaft.

10 Claims, 6 Drawing Figures

RADIAL MINING METHOD

BACKGROUND OF THE INVENTION

1. Field of the Invention

This invention lies in the field of mineral mining. More particularly, it is concerned with a system of mineral mining in which a relatively short working shaft is provided which is started regularly from the bottom of a vertical or slope shaft extending from the surface. A wall in a mineral strata is cut away either by long wall techniques or by short wall techniques and the working face is in a sense rotated radially until a complete cylindrical portion of the seam is removed.

2. Description of the Prior Art

In the prior art many systems of mining minerals such as coal have been advanced. Elaborate mining machinery has been developed such as the continuous miner which can cut a short wall equal to the width of its cutting cylinder or sidewall cutters which can advance along the long wall. However, the subsurface is generally worked by a room and pillar method or a number of parallel horizontal shafts are first drilled by conventional methods and wide sections are cut back by a long wall, short wall, auger, and/or other conventional methods.

There are a number of areas in which improvements can be made in these types of operations, such as, roof falls, complete recovery, fresh air, shortest route, fire and maintenance. One of them involves the great length of roadway and transport that is required to bring in supplies and to carry out minerals from the working face to the mouth of the mine, which is greatly reduced by this invention.

Furthermore, the national average for recovery of these minerals is between 50 and 70% of the inplace material, which with this method the recovery can be virtually 100%. The reason for the poor recovery by conventional methods is because the material which is left cannot be recovered without excessive cost and/or endangering life by roof falls.

In the prior art systems there is great difficulty and expense in maintaining a safe roof, so that it does not fall and kill people, or cave in from the side. A consequence of the prior art systems is that the roof must be supported for the life of the mine since succeeding production is delivered through the areas of prior production.

In this invention, as soon as a long wall is advanced a selected distance the roof supporting means are moved, to an adjacent position, permitting the roof to cave, since there is no transport of material or personnel through that area.

And finally, there is the problem of maintenance, of the roof, of the mine proper, of the transport means and transport routes, electrical power, water, track, gas buildup, etc. Since all these routes are shortened in this invention, the maintenance is greatly simplified.

The conventional methods of mining have great fire hazards due to dust, spontaneous combustion, dead air spaces, worn or frayed electrical cables or other electrical equipment, etc. In this system the ventilation system is short and direct, permitting more rapid and complete changes of air.

SUMMARY OF THE INVENTION

It is a primary object of this invention to provide a method of mining an underground mineral seam with the shortest access and length of supply and delivery lines, and full control of all materials and equipment.

It is another object of this invention to provide a system of mining in which air can be introduced in one or more conventional vertical or slope shafts dug to the depth of the mineral seam, whereby it will flow radially out along a horizontal shaft to the working face and the entire involved work area, out to the limits, at a radius R of the entire mining operation, and back through a separate channel along the back side of a flexible curtain, to the axis of the underground operation and up to the surface through the same, or a second vertical shaft drilled from the surface. These and other objects are realized and the limitations of the prior art are overcome in this invention by providing one or more access shafts from the surface, vertically or sloping, downward to the mineral seam. This shaft is large enough for men and equipment to be lowered. A workroom is created at the base of the first vertical shaft wherein equipment can be assembled and where mined minerals are continuously carried to the surface. A second and/or third shaft is drilled, through which the displaced air is removed from the mine, fresh air being brought down the main shaft and radially along a working shaft to the outer margin of the work area.

The process works a given area of the mineral seam which is circular and has a selected radius R which may be the order of hundreds or thousands of feet or more as selected.

A first radial shaft is drilled from the workroom at the base of the first central vertical shaft radially outward to a selected radius R, by any selected means. The roof is supported by conventional means or preferably by means of hydraulic chocks, which are positioned as the shaft is advanced, there being space beside the chocks for the men and equipment to move to and from the working face. Some suitable means of carrying the material pieces such as coal, rock, mineral ore etc. back to the central shaft, such as a conveyor belt etc. is provided. In cutting the first shaft consider that the shaft is to be rotated in increments of angle A in one direction, such as counterclockwise in which the facing radially outward left wall will be cut away to advance the working face. The left wall becomes a long wall which will be mined in a more or less conventional long wall manner or by using a continuous miner cutting a selected width of shaft. It is directed at an angle clockwise or counterclockwise of the first shaft by the angle A and is advanced until the width of the second shaft equals the width of the cutter. It is then directed parallel to the left or first wall of the first shaft until the cut advances out to the radius R. Or the first cut is made while advancing from the control shaft to the radius R, and the second cut is made returning from the radius R to the center.

Also, the roof supports could be conventional props and timber close to the central shaft, out to a radius of say several hundred feet, since in this area the advance of the long wall is very slow. Out at greater distances, because of the rapid advance of the wall, hydraulic roof supports are much more efficient.

As the continuous miner advances the hydraulic roof supports, or chocks are extended to cover the roof area cleared by the mining machine, and further as necessary the chocks themselves are moved in the direction of the advance of the long wall, so that the roof being exposed by the continuous miner is continuously protected. Correspondingly after the long wall has moved a selected distance a portion of the roof of the first shaft will be unsupported and will be forced to crumble and collapse.

When the continuous miner reaches the maximum radius R, it is returned down the second shaft to the first point of departure where it changes angle and is redirected in the direction of angle A radially and advances until a third shaft is cut of the width of the continuous cutter and the miner is again rotated to be parallel to the second face of the second shaft and then it again proceeds out to the radius R and so on. It will be clear also that once the mining machine has reached the radius R, it can advance the long wall by cutting back toward the center.

When a continuous sector of the cylindrical area to be cut has been completed, the continuous miner is again returned to the center at the workroom and directed at a new angle which is equal to 2A compared to the radial direction of the first shaft and it proceeds radially outward and then turns parallel to the third wall and so on as was previously done. The important thing is that as the miner advances outwardly, the roof supports are extended so that they cover the roof to the new long wall face being formed, and as the continuous miner is brought back to an intermediate or starting point the supports are moved over so that they completely cover the second, third or succeeding shafts that have been cut. Thus, there are always roof supports from the central shaft along the entire work face to the radius R and adjacent to the advancing continuous miner. As the mining machine advances, the extensions on the roof supports are extended to protect and hold the roof until the next cut is made. Thus, men and equipment are protected at all times and stages of operation, by roof supports and clean fresh air.

This procedure of advancing the cutter, extending the roof supports and as the cutter is withdrawn, advancing the roof supports in the direction of the new wall, is conventional. The important part of this invention lies in the fact that the long wall is essentially a long radial, or almost radial, wall. One end of the wall is always at the center shaft, and therefore material must be carried only for a maximum distance of R from the working face to the point at which it can be raised to the surface, creating the absolute minimum distance, and least handling.

A second feature of great importance is that back of the roof supports or chocks, that is, the ends of the chocks opposite to that which is extensible, there is a flexible curtain or seal member which forms a semi-seal curtain wall, continuous from the central workroom and shaft out to the radius R. This divides and seals the working shaft area from the preworked shaft area, in which the roof is crumbling.

This radial curtain wall now acts as a dividing wall between fresh air which is drawn or forced down the central shaft. The fresh air moves radially out through the last shaft being cut, to the working face, picks up all the dust and contaminated air, carries it out to the outer wall at radius R, around the last chock, which may provide a supporting roof spaced away from the outer wall, so that the air can move around the last chock and back behind the curtain wall to the center of the work area, and up a second shaft to the surface. The air can be forced down the central shaft or can be evacuated up the second shaft. Either way is satisfactory.

BRIEF DESCRIPTION OF THE DRAWINGS

These and other objects and advantages of this invention and a better understanding of the principles and details of the invention will be evident from the following description taken in conjunction with the appended drawings in which.

DESCRIPTION OF THE PREFERRED EMBODIMENT

Figure 1:
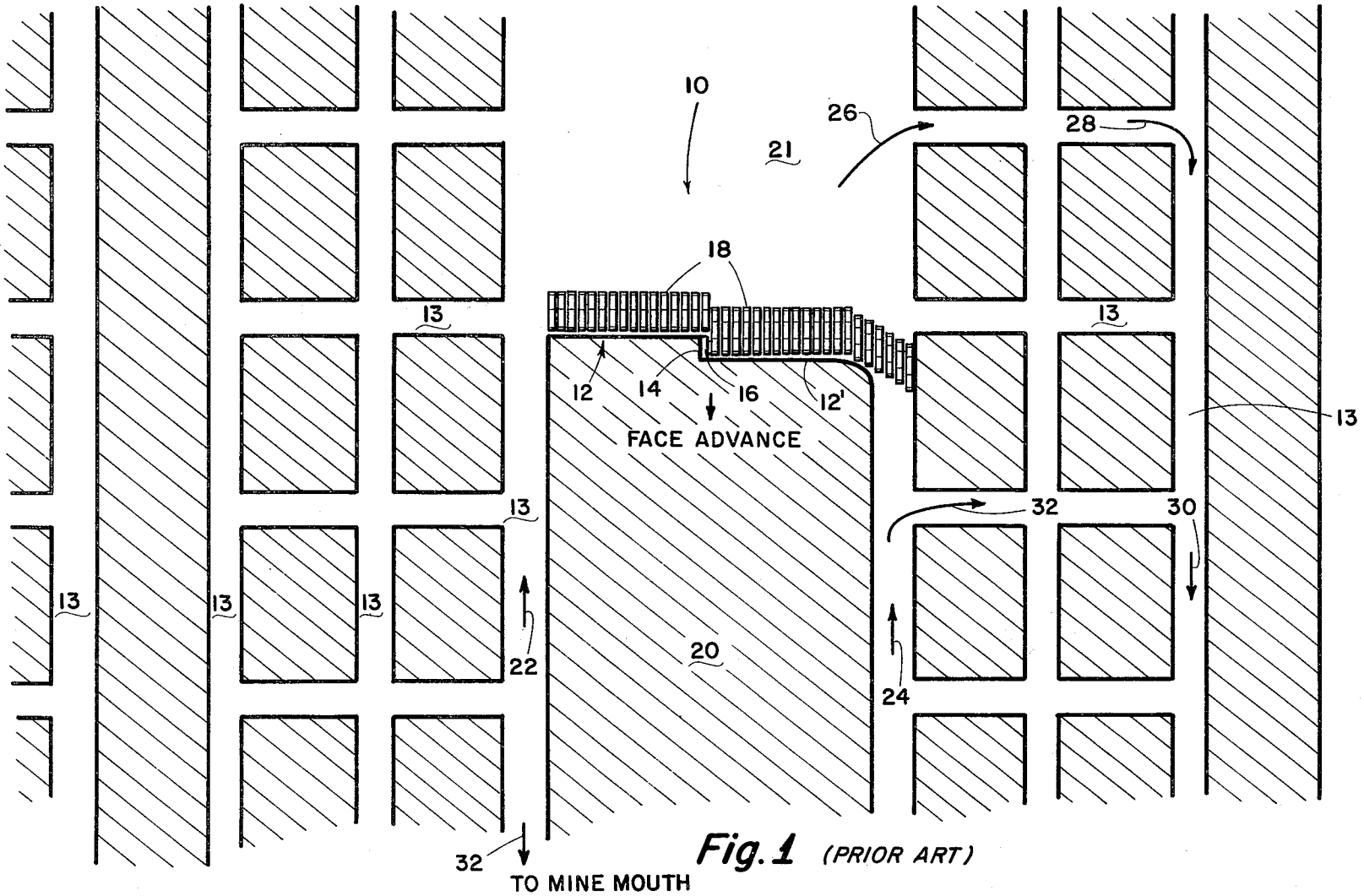
Fig. 1 (PRIOR ART)
FIG. 1 shows a prior art conventional short wall type of mining.

Referring now to the drawings and in particular to FIG. 1, there is shown a prior art method of operation in which a large underground area of mineral seam is mined in what is called the short wall method or room and pillar method. There are a plurality of longitudinal and transverse roadways which leave a plurality of pillars to support the roof in order to permit safe working space along the roadways while leaving a large area 20 which is to be mined out completely leaving a room 21 of collapsed rock from the roof of the room. The room is mined along a short wall 12 by conventional techniques, in which a continuous miner 16 advances along short wall 12. Numeral 18 indicates a plurality of hydraulic chocks as will be described in connection with FIGS. 3 and 4 which support the roof adjacent the wall 12, and the fresh portion of the wall 12'.

In the prior art, there are mining machines such as the continuous miner 16 and the hydraulic chocks 18 and other devices such as belt conveyors and other equipment (not shown) which are utilized in this method.

Figure 2:
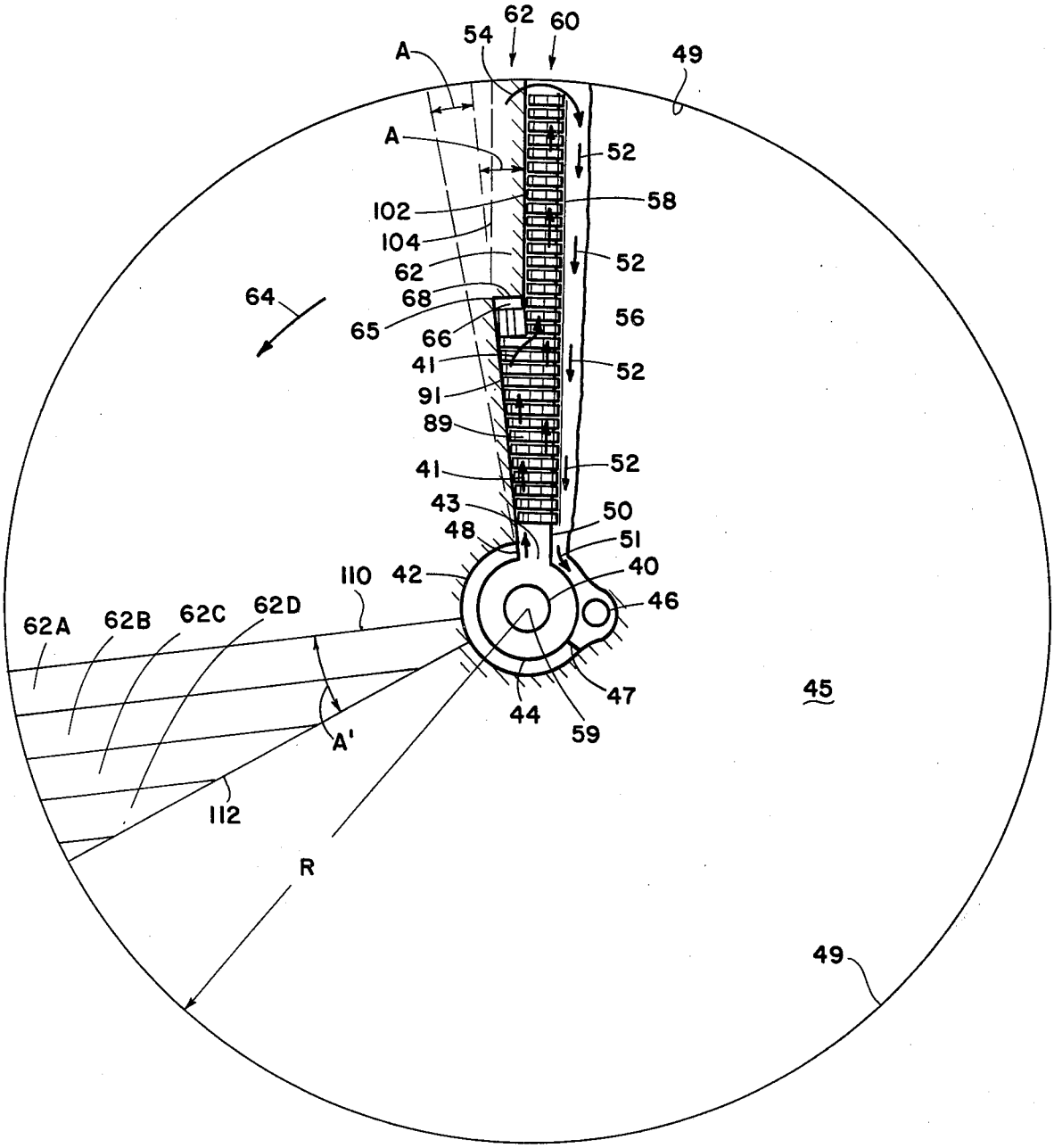
FIG. 2 is a horizontal plan view showing the method of mining of this invention.

Referring now to FIG. 2, there is indicated the general procedure by which an underground mineral seam is mined according to this invention. It comprises drilling first a vertical or slope shaft 40 from the surface of the earth down to the depth of the more or less horizontal mineral seam. It is intended to remove a circular slab of the mineral of a radius R (of many hundreds of feet) in the form of a cylinder of wall 49, leaving a room of area 45, of mineral to be removed. The shaft 40 is large enough for men and equipment to be lowered. Equipment may be lowered in unassembled form and assembled in a workroom 42 created at the bottom of the first central shaft 40.

A first horizontal radial shaft 60 is dug or mined from the central shaft 40, or from the central workroom 42, radially outwardly to the radius R and the wall 49 which, will be the limit of operation. This radial shaft can be cut by any selected conventional method which will include the work area and space for movement of men and material. When cut, it provides a long wall 102 which is substantially radial from the central shaft 40 to the wall 49. Once the first long wall is created and chocks 89 are set, then a second radial long wall 41 is started at an angle A clockwise or counterclockwise (as shown) from the first wall 102.

Figure 3:
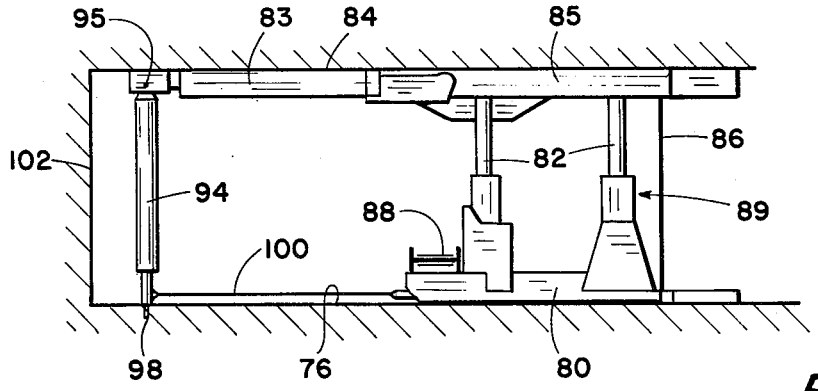

A continuous miner 66 of conventional design has a long cutting cylinder, generally of the order of 8 to 12 feet wide so that it, as it advances, advances the wall 9 to 12 feet and of sufficient height to provide a roof 84 and a floor 76, FIG. 3, which presumably will correspond to the upper and lower interfaces of the mineral seam, and/or of sufficient height for machinery and men.

The continuous miner indicated by the numeral 66 starts at the central workroom and advances outwardly along a radial line 91 until the working face 68 begins to depart from the first wall 102. In other words, the second wall is now being advanced by the width of the cutter 66 and the short wall 68. The direction of the continuous miner 66 is then turned to be parallel to the first wall 102 and as it advances outwardly it will create a second wall 104 shown in dashed line.

Figure 4:
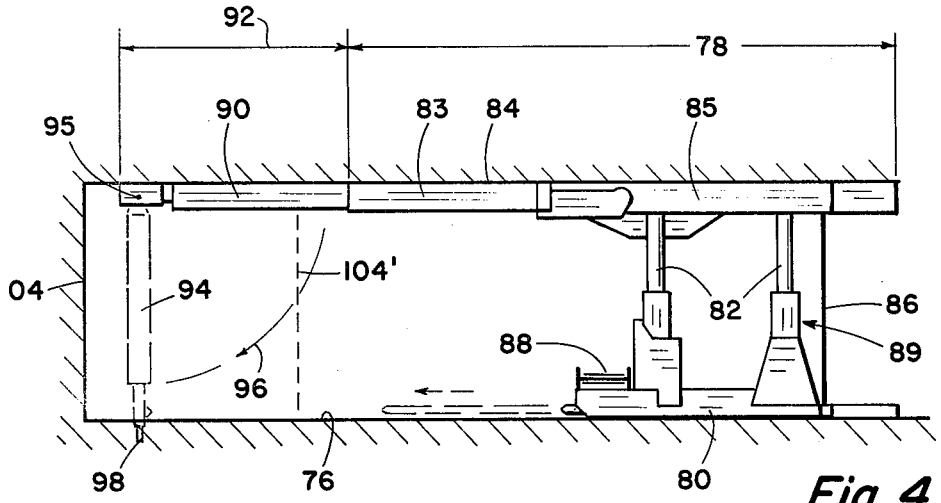
FIGS. 3 and 4 indicate the manner in which the hydraulic chocks are utilized.

Referring now temporarily to FIGS. 3 and 4, there is shown a section of the mine with a roof 84, a floor 76 and a first wall 102. A chock indicated generally by the numeral 89 has a base 80 which rests on the floor and it has four vertical cylinders based in a rectangle which support a rigid structure indicated by numeral 83 and 85. 83 is a hydraulic cylinder which has rams 90 which can be extended as shown in FIG. 4. Incidentally, in normal operations the vertical cylinder 94 is lifted in horizontal position to the part 83.

The dashed vertical line 104' represents in FIG. 4 the wall 102 in FIG. 3. In other words, if FIG. 3 represents the first shaft 60 the first wall 102 would be in the position of the dashed line 104'. Now as the continuous miner moves to the left, and widens the width of the total shaft 1 and 2, the extensible portion 90 of the chocks is moved out as in FIG. 4 so that the roof is supported out to the line 104 or 65 close to or as far out as possible to the new wall 104.

The extended position from the base 80 out to the wall 104 is now greater than the width of the continuous mining cylinder and so the miner can be withdrawn through the opening between the wall 104 and the base 80 of the chock 89.

In other words, as the miner is deflected along and parallel to the wall 102, it provides a new long wall 104 which is faced by the width of the cutter cylinder and as it moves outwardly the chocks are extended to support the newly formed roof until the miner reaches the wall 49.

At that point it is withdrawn back along the second shaft 62 to the first deflection point at which it was changed in direction from the angle A to be parallel to the first wall 102. It will be clear that the continuous mining machine can cut the face moving inward radially, as well as outward.

In the next cut, the continuous miner 66 will move out parallel to the wall to the line at angle A and cut a complete radial wall out to the limit 49. There is now a new radial wall and the cutter is brought back to the center workroom and a new line at an angle twice the angle A from the original radial line 102 from the first shaft is started, and is continued as has been described.

Because of the scale of the drawing it seems as though the second wall 104 is substantially the same as the radial direction at angle A. However, that is not necessarily the case. As shown in FIG. 2, if the angle A' is much larger than in the sector between the radial lines 110 and 112 for example, there could be considerably more parallel shafts 62A, 62B, 62C, 62D and so on.

There is no attempt to limit the variety of geometrical patterns or directions (right or left) or direction of cut (outward or inward) that may be devised. The important thing is that there is an essentially radial long wall starting from the central shaft at the center 40, and the workroom 42 out to the outer wall 49 at radius R. This wall can be advanced in a clockwise or counterclockwise direction as shown by arrow 64, or in any selected manner such as by long wall mining technique, short wall mining technique, or other modern cutting technique.

In further connection to FIG. 2, there is shown a line 58 (which in FIGS. 3 and 4 is under the protective roof of the chocks and indicated by numeral 86), which represents the flexible curtain separating the work space under the chocks, from the worked out space behind the chocks and between the chocks and the fallen roof indicated by numeral 56. The area between 56 and 58 is the mined out area, sometimes described as the COB. The material 45 to the right of line 56 is the virgin material wall of the original radial cut.

In the workroom 42, there is provided a cylindrical wall 44 which may be masonry wall or other proven material from floor to ceiling which has an opening 43 which faces the work shaft 60 and 62, etc. The cylindrical wall 44 has one wing 48 which seals against the wall 42 of the workroom and it has another wall 50 which connects to the curtain hanging under the chocks, indicated by the line 58. Thus, air which moves down the shaft 40 in accordance with arrows 41 and out toward the wall 49, passes around the last chock near the outer wall 49 and returns in accordance with arrows 52 in the space between the flexible curtain 58 and the fallen rock 56, which was cut by the first shaft out to the radius R. The air flow indicated by numeral 52 passes into the annular space 51 between the outer wall 42 of the work room and the wall 44, and then passes up to the surface through the second vertical shaft 46. This drive of fresh air 41 is forced to and past the work face, and out to the radius R of the wall 49 and back behind the curtain 58 to the second vertical shaft 46 to the surface, the air can be driven or pulled by conventional methods. This suction, or force, or both, will cause fresh air to move into the mine and to flood the face with fresh air, and carry all the pollution and dust and gas out to the wall 49, and back to the surface by means of the path along the walls 58 and 56 and up the vertical shaft 46.

Figure 6:
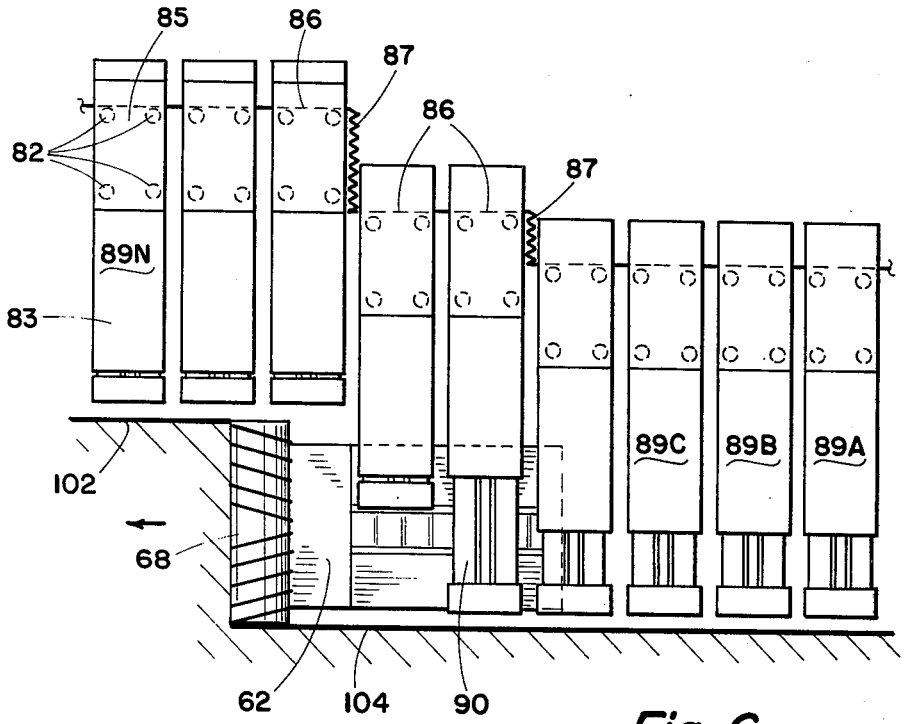
FIGS. 5 and 6 illustrate the manner of working the radial long wall by a continuous cutting procedure.
Figure 5:
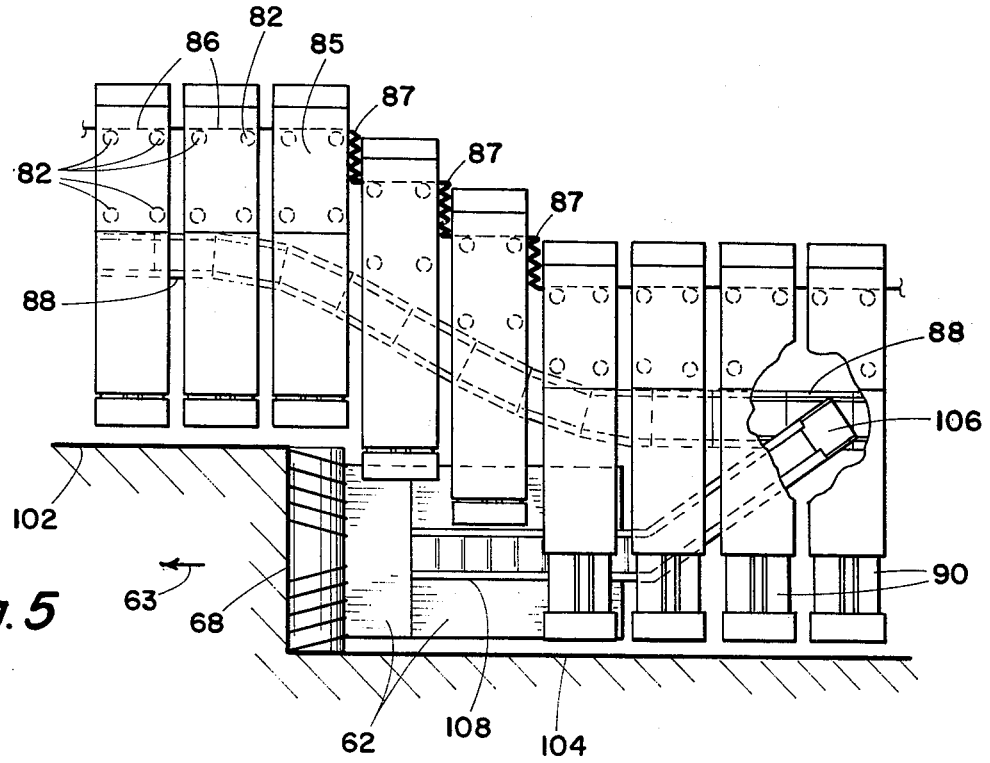

Referring now to FIGS. 5 and 6, they illustrate how the long wall 102 is cut to a displaced long wall 104 by advance of the continuous miner 62 which by practicing known techniques carries a rotating drum of cutters which can be raised and lowered from the position of cutting the floor to the position which cuts the ceiling or roof and moves outwardly along a short face 68 in accordance with arrows 63.

As the miner moves outwardly, the chocks are extended as shown by extension of the ramps 90 and they are also moved laterally as may be required to fully cover the roof which is exposed by the passage of the miner.

The cut mineral can be transported by means of a conveying system indicated schematically by 88 supported on the base 80 of the chock and indicated in dashed lines in FIG. 5.

The continuous curtain 86 is shown in FIGS. 5 and 6 with additional flexible curtain 87 placed between the chocks so that even though they are moved laterally with respect to each other there is a continuous dividing wall between the space on the front side of the wall and the space on the back side of the wall.

What has been described is a novel method of mining a large underground seam of mineral which has several important benefits. It provides a method of mining as large an area as desired in a circular cylindrical fashion.

The access to the work area is by means of a conventional central shaft through which men, materials and fresh air are passed. Starting with a first radial work shaft which is cut by any conventional method, which provides a long wall which is essentially in a radial direction, this wall is advanced in a clockwise or counterclockwise direction as desired. Roof supports, preferably of hydraulic design, or chocks, which are sequentially positioned behind a continuous miner and are extended as necessary to cover the newly exposed roof. As the continuous long wall is advanced the continuous miner is brought back, or cuts the wall back, and the new angle is set to advance the wall more or less continuously in a radial direction until a complete circular passage of the wall has been carried out.

As the wall advances the chocks which support the roof are advanced and the unsupported roof is then permitted or forced to collapse. The subsidance of the roof material fills the space that has been mined. When a complete traverse, or the complete revolution of the working face is made, the entire cylindrical area and volume has been mined and the equipment can be retrieved through the central shaft, or shafts.

There are several important features of this type of mining such as the following:

1. completely eliminates human exposure to roof falls;
2. fresh air is supplied to the entire mine, not to just selected pockets;
3. virtually 100% recovery of material;
4. shortest possible route for supplying and delivering materials, supplies, equipment, power, services, personnel, etc.;
5. instant and continuous control of all operations;
6. less maintenance;
7. safer — no intersections or stress points, no fire, minimum roof supports required, etc.;
8. can follow the slope of the seam to greater slopes than in other methods.

The length of path required for the transported material and men from the mouth of the mine to the working face is reduced tremendously which reduces the cost of those parts, cost of transport of material and means for providing necessary services, and so on.

Another principal benefit is provided by the fact that clean fresh air passing down through the central shaft or shafts can move radially through the shaft at which the face is being advanced, and provide fresh air directly to the work base, and then carry the dust and pollution radially outward to the circular wall and back behind the chocks and the flexible curtain to a second vertical shaft and thus to the atmosphere.

It will be clear that the "radial" pattern of cutting can be varied from narrow pie slices, to the "radial plus parallel" pattern described above. The important factor being that the long wall starts at the central shaft and ends along the outer circular wall. The particular shape of the intervening path of the working face is not critical. However, a straight wall is most convenient.

Also, if the lower interface of the mineral seam is not precisely horizontal, the radial shaft would follow the slope of the base of the seam.

The presence of the radial flexible curtain or closure wall is important since it provides the optimum method of providing a continuous flow of fresh air to the entire working face, while carrying the foul air with its dust and gas by a separate route to a second central shaft to be processed and released to the atmosphere.

It is desirable therefor to set up the closure wall under the roof supports as they are set up while drilling the first radial shaft. In other words, as the shaft is extended and additional roof supports are added, the closure wall is also extended. Thus the operators of the mine equipment are never working beyond their clean air supply.

While the invention has been described with a certain degree of particularity, it is manifest that many changes may be made in the details of construction and the arrangement of components. It is understood that the invention is not to be limited to the specific language used nor the specific embodiments set forth herein by way of exemplifying the invention, but the invention is to be limited only by the scope of the attached claim or claims, including the full range of equivalency to which each element thereof is entitled.

What is claimed:

1. A method of mining a subterranean mineral seam, for complete removal of said mineral over a selected circular area, and for minimum distance of transport of supplies and product, comprising:

(a) drilling at least a first large diameter central vertical or slope shaft, at a selected point on the surface of the earth, down to the selected seam of said mineral;

(b) enlarging said shaft at its base in said seam to a selected radius to form a workroom;

(c) drilling at least a second small diameter central shaft parallel to said first shaft adjacent said workroom;

(d) drilling a first radial shaft in said seam, from said workroom, to a selected radius R, by any conventional method, using movable roof supports such as extensible hydraulic chocks to support the roof, said chocks placed at successive radial distances from said workroom; with their extensions directed to the first wall on a first side of said first radial shaft;

(e) after said first radial shaft is complete, using a continuous mining method, directed radially, at a selected angle A to the axis of said first radial shaft, on said first side of said first shaft, drilling a second radial shaft;

(f) as said continuous miner moves radially outwardly, successively extending the extensible portion of said chocks to support the new roof area;

(g) when said second radial shaft reaches a first deflection point where said second shaft becomes as wide as the cutter of said continuous miner, changing the direction of advance of said miner to a direction parallel to that of said first shaft; whereby said first wall of said first shaft will be advanced by the width of said cutter.

2. The method as in claim 1 including the additional steps of:

(h) providing a flexible curtain closure wall, or air seal, under the roof support, along the ends of said chocks opposite to said extensible portion, said closure wall directed substantially radially from said workroom;

(i) creating an enclosure inside said workroom comprising a substantially circular wall with an opening leading to said first and second radial shafts, one side of said opening continuing radially to said closure wall; and (j) forcing fresh air down said first shaft, inside said enclosure, and substantially radially outwardly through said first and second radial shafts on a first or work side of said closure wall, to the end of said radial shafts, around the end of said closure wall, and back radially to said second central shaft to the surface.

3. The method as in claim 2 including the following steps:

(k) when said continuous miner reaches the radius R in said second shaft, returning said continuous miner through said second shaft to said first deflection point;

(1) as said continuous miner is returned to said first deflection point, retracting the extended portions of said hydraulic chocks and succesively moving them circumferentially in said first direction into said second shaft; whereby said first shaft roof at the outer part is unsupported and can collapse; and whereby moving said chocks in said first direction provides greater space on the other side of said closure wall for the passage of return air to said second central shaft.

4. The method as in claim 3 with the additional steps of:

(m) redirecting said continuous miner along said radius at said angle A to provide a third shaft;

(n) when said third shaft reaches a radius of a second deflection point and widens to equal the width of the cutter on said miner, and the first wall of said second shaft is cut away;

(o) redirecting said continuous miner in a direction parallel to said second shaft, and proceeding the outer wall at radius R.

5. The method as in claim 4 including the steps of:

(p) repeating step (k) to said second deflection point;

(q) repeating step (1) to said second deflection point.

6. The method as in claim 5 including the following steps:

(r) when said continuous miner reaches a radius R, in said third shaft, returning said continuous miner through said third shaft, through a part of said second shaft and a part of said first shaft to said workroom;

(s) as said continuous miner is returned, retracting the extended portions of said chocks and successively moving them circumferentially in said first direction into said third shaft, whereby there is provided a continuous protected shaft from said workroom through part of said first and second shafts and said third shafts;

(t) advancing said miner radially at an angle of 2A to the direction of said first shaft until the shaft width is equal to the cutter width; and thereafter (u) advancing such that the first wall of said first, second and third shafts is cut away.

7. The method as in claim 2 in which said step of providing a flexible curtain closure wall is carried out progressively as said first radial shaft is drilled.

8. The method as in claim 1 including after the continuous miner has progressed out to the said radius R of advancing the working face in said first direction a selected distance and cutting the short wall face as said miner progresses radially inwardly toward said central shaft.

9. The method as in claim 1 in which said radial shaft is drilled with its floor substantially coincident with the bottom of said mineral seam.

10. A method of mining a subterranean mineral seam, for complete removal of said mineral over a selected circular area, and for minimum distance of transport of supplies and product, comprising:

(a) drilling at least a first large diameter central vertical or slope shaft, at a selected point on the surface of the earth, down to the selected seam of said mineral;

(b) enlarging said shaft at its base in said seam to a selected radius to form a workroom;

(c) drilling at least a second small diameter central shaft parallel to said first shaft to intersect said workroom;

(d) drilling a first radial shaft in said seam, from said workroom, to a selected radius R, by any conventional method, using movable roof supports to support the roof, said supports placed at successive radial distances from said workroom as the shaft is advanced;

(e) hanging a flexible curtain closure wall under said roof supports as said shaft is extended; and (f) forcing fresh air down said first shaft, and outwardly between the working face and said closure wall, around the end of said closure wall, and back of said closure wall to said second central shaft to the surface.

* * * * *